US005426489A

United States Patent [19]

Haneda et al.

[11] Patent Number: 5,426,489

[45] Date of Patent: Jun. 20, 1995

[54] IMAGE FORMING APPARATUS WITH A MAGNETIC BRUSH CHARGER

[75] Inventors: Satoshi Haneda; Kunio Shigeta; Sachie Hosogoezawa; Hiroyuki Nomori; Masakazu Fukuchi, all of Hachioji, Japan

[73] Assignee: Konica Corporation, Tokyo, Japan

[21] Appl. No.: 215,707

[22] Filed: Mar. 22, 1994

[30] Foreign Application Priority Data

Mar. 25, 1993 [JP] Japan ..... 5-066730

[51] Int. Cl.[6] ..... G03G 15/02

[52] U.S. Cl. ..... 355/219; 361/225

[58] Field of Search ..... 355/219; 361/221, 225, 361/230

[56] References Cited

U.S. PATENT DOCUMENTS 4,174,903 11/1979 Snelling ..... 355/219
4,462,679 7/1984 Itaya ..... 355/219 X
4,827,306 5/1989 Tsujimoto et al. ..... 355/219

FOREIGN PATENT DOCUMENTS 59-133569 7/1984 Japan .
63-187267 8/1988 Japan ..... 355/219
4-21873 1/1992 Japan .
4-116674 4/1992 Japan .
5-127490 5/1993 Japan ..... 355/219
5-134517 5/1993 Japan ..... 355/219

*Primary Examiner*—William J. Royer
*Attorney, Agent, or Firm*—Finnegan, Henderson Farabow Garrett & Dunner

[57] ABSTRACT

An image forming apparatus such as an electrophotographic copier and an electrophotographic printer. The image forming apparatus includes: a photoreceptor for forming a toner image on its surface; a charger for charging the surface with a bias voltage, including a DC component and a AC component, through a magnetic brush member which is in contact with the surface; a driving unit for moving both of the surface of the photoreceptor and the magnetic brush member in synchronism; a laser unit for imagewisely exposing a predetermined image area of the surface, which is charged by the charger, so that a latent image is formed on the surface; and a discharge lamp for exposing the surface with light so that the surface is discharged. In such the image forming apparatus, the discharge lamp starts exposing the surface with the light and the bias voltage, with which the surface is charged, is set at substantially 0 volt before the driving starts moving the surface and the magnetic brush member; and the predetermined image area of the surface is charged with the bias voltage, including the DC component and the AC component, after the driving starts moving the surface and the magnetic brush member.

4 Claims, 13 Drawing Sheets

IMAGE FORMING APPARATUS WITH A MAGNETIC BRUSH CHARGER

BACKGROUND OF THE INVENTION

The present invention relates to an image forming apparatus such as an electrophotographic copier, and an electrostatic printer, and specifically to an image forming apparatus having a magnetic brush type charging apparatus by which an image forming body is uniformly charged.

In a conventional electrophotographic type image forming apparatus, generally, a corona charger is used for charging an image forming body such as a photoreceptor. The corona charger impresses a high voltage upon a discharging wire in order to generate a strong electric field around the discharging wire, and to carry out gas-discharging. The image forming body is charged when ions, generated at the aforementioned operations, are attracted by the image forming body.

As described above, the corona charger which is used for the conventional image forming apparatus can charge the image forming body without mechanically contacting therewith, and therefore, the corona character has an advantage in which the image forming body is not damaged through the charging operation. However, a corona discharger also has disadvantages in which: there is danger that an operator receives an electric shock because high voltage is used in the charger; there is also danger of electrical leakage; ozone generated during gas-discharging is harmful to humans; and the corona discharger shortens the life of the image forming body. Further, the charging voltage potential from the corona charger is unstable because it is strongly affected by temperature and humidity. Yet further, in the corona charger, noises are generated by high voltage, which is a large disadvantage when an electrophotographic image forming apparatus is used as a communication terminal or an information processing apparatus.

The above-described disadvantages of the corona charger are attributed to gas-discharging during charging of the image forming body.

In this connection, the following charging apparatus has been disclosed in Japanese Patent Publication Open to Public Inspection Nos. 133569/1984, 21873/1992, and 116674/1992, in which a magnetic brush is formed by attracted magnetic particles on a cylinder in which a magnet is housed, and charging is carried out when the surface of the image forming body is rubbed by the magnetic brush, as a charging apparatus in which high voltage gas-discharging as in the case of the corona charger is not conducted; the image forming body is not mechanically damaged; and the image forming body can be charged.

However, in the charging apparatus disclosed in the above publications, the following problems have been caused: the image forming body is damaged or uneven charge occurs when the magnetic particles are moved and deposited onto the image forming body at the start and stop of the charging operation. Further, when toner enters into the charging apparatus, the charging capacity is lowered, so that problems of deposition of magnet particles have occurred.

An object of the present invention is to solve the above-mentioned problems and to provide an image forming apparatus with a magnetic brush type charging apparatus in which deposition of magnetic particles onto the image forming body does not occur, no ozone is generated, and stable and uniform charging can be carried out.

SUMMARY OF THE INVENTION

The above-mentioned objects can be accomplished by the following two embodiments. The first embodiment provides an image forming apparatus characterized in that: the image forming apparatus has a magnetic brush type charging apparatus in which charging is carried out when the magnetic brush is lightly contacted with the image forming body; the image forming body and a charging roller holding the magnetic brush, or a magnet housed inside the charging roller are driven simultaneously; (1) at least, before the drive, the image forming body is irradiated with a beam of light sent from a discharge lamp, and a bias voltage of almost 0 V is applied to the magnetic brush; (2) next, the drive is carried out, and the bias voltage is changed to an AC bias voltage on which a DC component is superimposed in an image area. Further, the first embodiment provides an image forming apparatus characterized in that: the image forming apparatus has a magnetic brush type charging apparatus in which charging is carried out when the magnetic brush is lightly contacted with an image forming body; the image forming body and the charging roller holding the magnetic brush, or the magnet housed inside flee charging roller are driven simultaneously; (1) after a formed image has passed the image area, the image forming body is irradiated with a beam of light sent from the discharge lamp, and the applied bias voltage onto the magnetic brush is changed from the AC bias voltage, on which the DC component is superimposed, to a low voltage of almost 0 V; (2) next, the drive stops; (3) the irradiation of the beam of light sent from the discharge lamp also stops. The second embodiment provides an image forming apparatus characterized in that: the image forming apparatus has a magnetic brush the charging apparatus in which charging is carried out when the magnetic brush is lightly contacted with an image forming body; the image forming body and the charging roller holding the magnetic brush, or the magnet housed inside the e charging roller are driven simultaneously; (1) at least, before the drive, only an AC component is applied onto the magnetic brush as a bias voltage; (2) the drive is carried out; and (3) in the image area, the DC component is superimposed on the AC component. Further, the second embodiment provides an image forming apparatus characterized in that: the image forming apparatus has a magnetic brush type charging apparatus in which charging is carried out when the magnetic brush is contacted with an image forming body; the image forming body and the charging roller holding the magnetic brush, or the magnet housed inside the charging roller are driven simultaneously; (1) after the formed image has passed the image area, the bias voltage is changed from the AC bias voltage, on which the DC component is superimposed, to the Ac bias voltage including only the AC component; (2) next, the drive stops; and (3) the application of the AC component of the bias voltage stops.

In the image forming apparatus according to the present invention, charging is carried out stably and uniformly by contacting the magnetic brush with the image forming body, and it is necessary to carry out the charging operation by periodically exchanging the magnetic brush, which contacts with the image forming body, with new magnetic particles. Accordingly, the image forming apparatus, according to the present invention, is structured as follows: the image forming body is combined with a charging roller, holding the magnetic brush, or the magnet, housed inside the roller, through gears; and the image forming body, and the charging roller or the inside magnet are driven simultaneously. A feature of the combined structure of gears is a simple driving mechanism. However, there is a problem in which, since the charged image forming body or the discharged image forming body passes the charging section, magnet particles deposit onto the image forming body depending on the situation, when a potential difference exists between the image forming body and the charging roller. In the present invention, the potential difference does not exist between the image forming body and the magnetic brush outside the image forming area.

In the first embodiment, the photoreceptor surface of the image forming body is irradiated with a beam of light sent from the discharge lamp so that the potential voltage of the photoreceptor surface is lowered. Before the drive of the image forming body is started, the discharge lamp is turned on, and after the drive of the image forming body has been stopped, the discharge lamp is turned off. The bias voltage for charging is a low voltage of almost 0 V when the discharge lamp is turned on, and next, the image forming body is driven. In the image area, the bias voltage is changed to an AC bias voltage on which the DC component is superimposed. After the image has passed the image area, the bias voltage is changed to a low voltage of almost 0 V, and after the drive of the image forming body has been stopped, the discharge lamp is turned off.

In the second embodiment of the present invention, when the bias voltage, including only an AC component, is applied onto the image forming body, the potential difference between the charging roller and the image forming body is decreased or eliminated, so that the deposition of magnet particles on the image forming body is prevented. In the embodiment, the following operation is carried out: before the image forming body is rotated, the bias voltage, including only an AC component, is applied onto the image forming body; next, the drive of the image forming body is started; a DC component is superimposed on the AC component, and the bias voltage is applied onto the image forming body; after the image has passed the image area, the bias voltage is changed to a voltage including only the AC component; next, the drive of the image forming body is stopped; and the application of the bias voltage is stopped.

A size of the magnetic particle, which is used for magnetic brush type charging, will now be described. Generally, when an average particle size of the magnetic particle is large, the following problem occurs: (A) since bristles of the magnetic brush formed on a magnetic particle carrier are rough, even when the image forming body is charged while the magnetic particles are being oscillated by the electric field, an uneven magnetic brush tends to be formed, so that the image forming body is unevenly charged. In order to solve the above problem, the average particle size of the magnetic particle is preferably small. As a result of our experiments, the following were found: when the average particle size is smaller than 150 μm, the desired effect is provided; and specifically, when the average particle size is smaller than 100 μm, the problem (A) basically disappears. However, when the particle size is too small, the particles deposit onto the surface of the image forming body, or scatters at the time of charging. These phenomena have relation to the strength of the magnetic field which acts on the particles, and relation to the strength of magnetization onto the particles. However, generally, the phenomena become obvious when the average particle size is smaller than 30 μm. In this connection, the strength of the magnetization of the particles is preferably 20 to 200 emu/g.

From the foregoing, the average particle size of the magnetic particle is preferably smaller than 150 μm, and more preferably, smaller than 100 μm and larger than 30 μm.

Such magnetic particles can be obtained by selecting the following particles, which are the same as conventional magnetic carrier particles, by a conventional average particle selection means: particles made of metal such as iron, chromium, nickel or cobalt, compounds or alloys made of them, or ferromagnetic particles, such as triion tetroxide, y-ferric oxide, chrome dioxide, manganese oxide, ferrite, or manganese-copper alloy; particles in which the surfaces of these magnetic particles are coated by resin such as styrene resin, vinyl resin, ethylene resin, rosin modified resin, acrylic resin, polyamide resin, epoxy resin, or polyester resin; or particles made of resin in which magnetic minute particles are dispersed and contained.

When spherical magnetic particles are formed, a particle layer formed on the magnetic particle carrier is evenly formed, and further, high bias voltage can be uniformly applied onto the magnetic particle carrier, both of which are advantageous. That is, when spherical magnetic particles are formed, the following effects are obtained: (1) generally, although the magnetic particle is easily attracted by magnetization in the major axis direction, the orientation is lost due to the spherical formation, and accordingly, the layer is uniformly formed, and the generation of a locally low resistant area and the uneven layer thickness can be prevented; (2) since the magnet particles are made highly resistant, an edge portion which can be seen in conventional particles is lost, the concentration of the electric field on the edge portion does not occur, and as a result, even when a high bias voltage is applied onto the magnet particle carrier, the surface of the image forming body is uniformly charged, and uneven charging does not occur. As the spherical particle having the aforementioned effects, it is preferable that a conductive magnetic particle is formed so that the resistivity of a carrier particle is more than $10^3$ Ω, and less than $10^{12}$ Ω, specifically, more than $10^4$ Ω, and less than than $10^9$ Ω. The value of the resistivity can be obtained from the following operations: after particles are introduced into a vessel having a sectional area of 0.50 $cm^2$ and compacted by tapping, a weight of 1 $kg/cm^2$ is loaded on the above particles; and a voltage, by which the electrical field of 1000 V/cm is generated, is applied between the above-mentioned weight and an electrode on the base of the vessel, and the value of a current at the time is read. In the case where the resistivity is low, when a bias voltage is applied onto the magnetic particle carrier, an electric charge is injected into the magnetic particle, and the magnetic particles tend to adhere to the surface of the image forming body, or the bias voltage is easily broken down. When the resistivity is high, no electric charge is injected into the particles, and the magnetic particles are not charged.

Further, it is preferable for the magnet particles, according to the present invention, to have a low specific weight and the maximum magnetic susceptibility so that the magnetic brush, composed of magnetic particles, is easily moved by an oscillating electric field, and further, no magnetic particles scatter to the outside of the device. Specifically, it has been found that good results can be obtained when the magnet particles having a true specific weight of less than 6, and the maximum magnetic susceptibility of 30 to 100 emu/g, is used.

From the aforementioned, the most appropriate condition of the magnetic particles is the following: the spherical magnetic particles are formed so that the ratio of the major axis to the minor axis is less than 3; the magnet particles have no projection such as acicular portions and edge portions; and the resistivity is preferably more than $10^4\ \Omega$ and less than $10^9\ \Omega$. The aforementioned spherical magnetic particle is produced by the following: the magnet particles, to be as spherical as possible, are selected; in the case of the particles of the magnetic minute particle dispersion system, the magnetic particles, to be as minute as possible, are used, and processing for spheres is carried out after the dispersed resin particle has been formed; or the dispersed resin particles are formed by the spray drying method.

Since the magnet particle directly contacts with the image forming body in the present invention, when the toner, which is used for development, is mixed with the magnetic brush, the charging property is lowered and uneven charging occurs because the insulating property of the toner is high. In order to prevent the above-mentioned problem, it is necessary that the amount of electric charge of the toner is small so that the toner is moved to the image forming body when the toner is charged. Accumulation of the toner onto the magnetic brush can be prevented when the polarity of the toner is the same as the charging polarity, and the amount of triboelectricity of the toner is 1 to 20 $\mu$C/g, under the conditions that toners are mixed with the magnetic particles, and the density of the toner is prepared to 1%. This result can be considered as follows: even when the toners are mixed with the magnetic particles, the toners are adhered onto the photoreceptor during a charging operation. The following results were found: when the amount of electric charge of the toner is large, it is difficult for the toner to be separated from the magnetic particle; and on the other hand, when the amount is small, it is difficult for the toner to be electrically moved to the image forming body.

The aforementioned conditions are for the magnetic particle, and next, the conditions concerning the magnetic particle carrier, by which the particle layer is formed and the image forming body is charged, will be described.

As the magnetic particle carrier, a conductive magnetic carrier, onto which the bias voltage can be applied, is used. Specifically, the magnetic particle carrier, having the structure in which a magnet having a plurality of magnetic poles is provided inside a conductive cylinder, on the surface of which a particle layer is formed, is preferably used in such a magnetic particle carrier, the particle layer formed on the surface of the conductive cylinder is wavy and moved when the cylinder is relatively rotated with respect to the rotary magnet. Accordingly, new magnetic particles are successively supplied. Even when the particle layer on the magnetic particle carrier is more or less unevenly formed, the influence is fully covered by the aforementioned waviness so that the influence remains negligible. The conveyance speed of the magnet particle by the rotation of the magnetic particle carrier or, further, the rotation of the magnet is preferably almost the same as the moving speed of the image forming body, or a little slower than the moving speed of the image forming body. Further, the conveyance direction of the magnetic particle by the magnetic particle carrier is preferably in the same direction as the contact surface of the image forming body with the magnet particle. The same conveyance direction is superior to the opposite conveyance direction in uniformity of charge. However, the present invention is not limited to the same conveyance direction. In the present invention, the image forming body is combined with the charging roller, which is the magnetic particle carrier, through gears or the like, and the image forming body is simultaneously rotated and stopped with the charging roller.

The thickness of the particle layer formed on the magnet particle carrier is preferably the thickness of the uniform layer which is fully scraped off by a regulating plate. When the amount of the magnetic particle layers which exist on the magnetic particle carrier is too large in the charging area, the magnetic particles are not fully oscillated the following defects appear: the photoreceptor is worn out; uneven charging is caused; an over current flows; and the driving torque of the magnetic particle carrier is too large. On the contrary, when the amount of the magnet particles on the magnet particle carrier is too small in the charging area, uneven charging, and the deposition of the magnet particles on the image forming body occur. The preferable existing amount of the magnet particles in the developing area is 10 to 200 mg/cm$^2$. This amount is an average value of the magnetic particles in the contacting area of the magnetic brush with the image forming body.

A gap between the magnetic particle carrier and the image forming body is preferably 100 to 5000 $\mu$m. When the surface gap between the magnetic particle carrier and the image forming body is smaller than 100 $\mu$m, it is difficult to form the bristles of the brush by which the surface of the image forming body is uniformly charged, and further, the sufficient magnetic particles can not be supplied to the charging section, so that charging can not be stably carried out. When the gap is larger than 5000 $\mu$m, the particle layer is rough, uneven charging tends to occur, and further, the electric charge injection effect is lowered, so that sufficient charging can not be carried out. As described above, the gap between the magnetic particle carrier and the image forming body becomes excessive, the thickness of the particle layer on the magnetic particle carrier can not be appropriately formed. However, when the gap is within the range of 100 to 5000 $\mu$m, the thickness of the particle layer can be appropriately formed, so that the generation of a sweeping pattern due to the sliding contact of the magnetic brush is prevented.

DETAILED DESCRIPTION OF THE INVENTION

Figure 1:
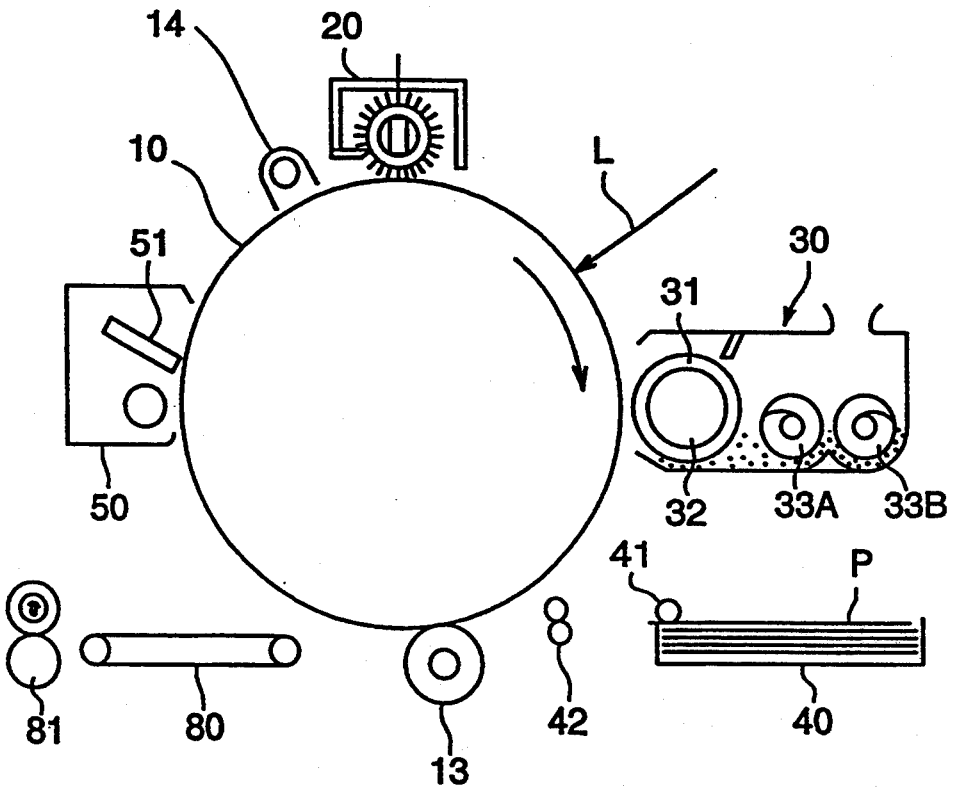
FIG. 1 is a sectional view showing a general structure of an image forming apparatus with a magnetic brush type charging apparatus according to the present invention.

Referring to the drawings, embodiments of a charging apparatus according to the present invention will be described below.

FIG. 1 is a sectional view showing a general structure of an electrostatic recording apparatus with a magnetic brush type charging apparatus according to the present invention.

In the drawing, numeral 10 is a photoreceptor drum which is an image forming body rotating in the arrowed direction (clockwise), and composed of a negatively charged (−) OPC. On the periphery of the photoreceptor drum, a discharge lamp (pre-charging exposure lamp) 14 by which pre-charging exposure is carried out, a magnetic brush type charging apparatus 20 (which will be described later), a developing unit 30, a transfer roller 13, a cleaning unit 50 and the like are provided, and an image exposure light L is sent from an exposure unit.

Figure 2:
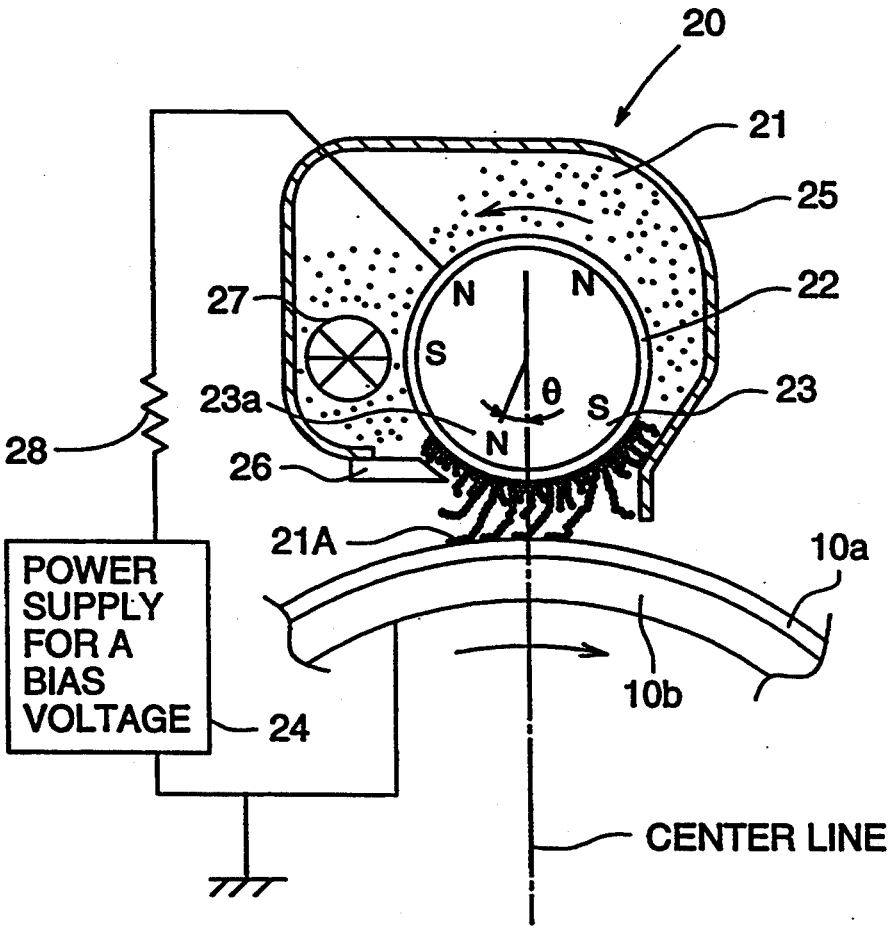
FIG. 2 is a sectional view showing an embodiment of the magnetic brush type charging apparatus according to the present invention.

FIG. 2 is a sectional view showing an embodiment of the charging apparatus used in the electrostatic recording apparatus shown in FIG. 1. In the drawing, numeral 21 is magnetic particles, which are spherical ferrite particles, coated in this case, so as to be conductive. Alternatively, the following can be used: magnetic particles and resin are main components; after thermal kneading of the magnetic particles and resin, they are pulverized; and conductive magnetic resin particles obtained by the pulverization can be used. In order to carry out good charging, spherical magnetic particles are prepared having a particle diameter of 50 μm, and specific resistivity of $10^8$ Ω·cm. An amount of triboelectric charging of the particle with a toner is −5 μC/g under the condition that the toner density is 1%.

Numeral 22 is a cylinder (charging roller) which is a particle carrier of the magnetic particles 21 formed of nonmagnetic but conductive metal such as aluminum. Numeral 23 is a rod-shaped magnet disposed inside the cylinder 22. This magnet 23 is magnetized in such a manner that S and N poles **23*a* are arranged in the periphery of the cylinder, as shown in the drawing, so that the strength of magnetization on the cylinder surface is 700 gauss. The cylinder 22 rotates with respect to the fixed magnet 23. Further, the magnet 23** may be rotated as a homopolar arrangement magnetic pole.

Figure 3:
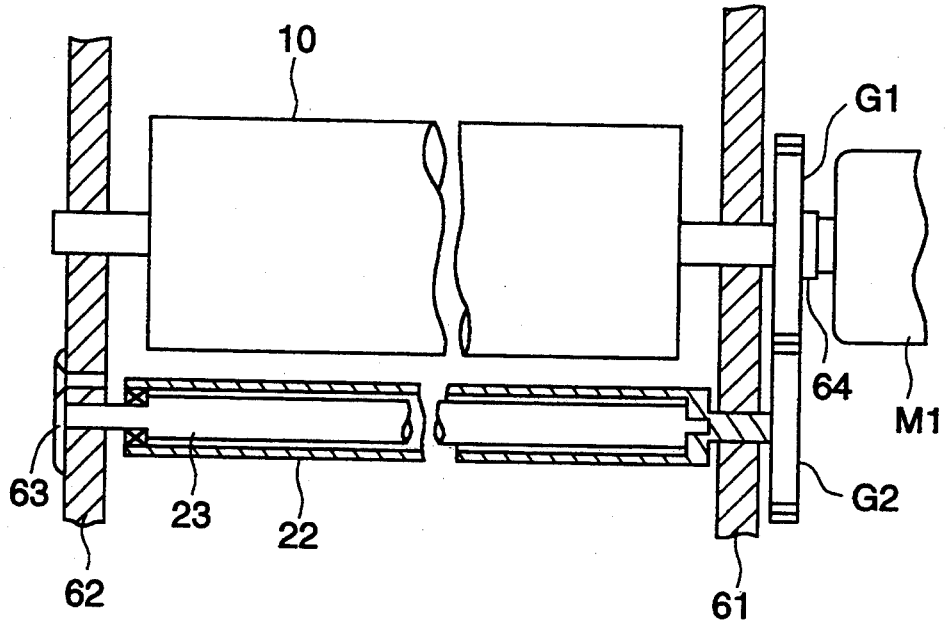
FIG. 3 is an illustration of a main portion showing a driving system of the present invention.

In the present invention, the cylinder 22 or the magnet 23 is connected to the photoreceptor drum 10 through gears, which are structured so as to be simultaneously driven. FIG. 3 shows an example of the above-mentioned structure. Both the photoreceptor drum 10 and the cylinder 22 are pivotally supported by side plates 61 and 62. A magnet 23 is housed in the cylinder 22, and one end of the magnet 23 is fixed to the side plate 62 with a fixing member 63. A positional relationship of the main magnet with the photoreceptor 10 is adjusted, and fixed. The photoreceptor drum 10 is rotated by a driving motor M1 through a coupling 64. A gear G1 is fixed to the shaft of the photoreceptor drum 10, a gear G2 is fixed to the shaft of the cylinder 22, and the gear G1 and the gear G2 are engaged. The gear G1 is also engaged with a developing sleeve 31 in a developing unit 30, and the geared relationship is neglected in the drawings. When an appropriate ratio of the gear G1 to the gear G2 is selected, the cylinder 22 is rotated in the same direction as the photoreceptor drum 10 at a circumferential speed of 0.1 to 1.0 times that of the photoreceptor drum 10 at the position opposed to the photoreceptor drum 10. A position of the main magnetic pole of the fixed magnet 23, which is closest to the photoreceptor drum 10, is preferably set in such a manner that an angle $\theta$ formed between a center line, which connects the center of the photoreceptor drum 10 to the center of the charging roller 22, and a straight line, which connect the center of the charging roller 22 to the main magnetic pole, is $0° \leqq \theta \leqq 15°$ at the upstream side of the photoreceptor drum 10.

The diameter of the cylinder 22 is preferably within 5 to 20 mmϕ. A contact area necessary for charging can be maintained by the aforementioned diameter. When the contact area is too large, the charging current becomes large, and when the contact area is too small, uneven charging often occurs. When the diameter of the cylinder is as small as described above, the magnetic particles are easily scattered or deposited to the image forming body by the centrifugal force. Accordingly, the circumferential speed of the magnetic particle carrier is preferably small. The average surface roughness of the cylinder 22 is preferably 2 to 15 μm so that the magnetic particles can be stably and uniformly conveyed. When the surface is smooth, the conveyance of the magnetic particles is not sufficiently carried out, and when the average surface roughness is too rough, the over current flows from protruding portions on the surface. In both cases, uneven charging easily occurs. Sand blast processing is preferred for the above-mentioned surface roughness.

The photoreceptor drum 10 comprises a conductive base material **10*b*, and a photoreceptor layer 10*a* with which the surface of the conductive base material 10*b* is covered, and the conductive base material 10*b*** is grounded.

Numeral 24 is a power supply for a bias voltage which applies the bias voltage between the cylinder 22 and the conductive base material **10*b***, and the cylinder 22 is grounded through the power supply for the bias voltage 24.

The power supply for the bias voltage 24 supplies an AC bias voltage, in which an AC component is superimposed on a DC component which is set to the same voltage value as that of the voltage to charge the photoreceptor drum. Although conditions are different depending on the dimensions of the gap between the cylinder 22 and the photoreceptor drum 10, and the charging voltage to charge the photoreceptor drum 10, preferable charging conditions are obtained when the gap is maintained between 0.1 to 5 μmm, and the AC bias voltage, in which the AC component of 200 to 3500 V is superimposed as a peak-to-peak voltage on the DC component of −500 to −1000 V, which is approximately the same value as that of the voltage to charge the photoreceptor drum, is supplied through a protective resistance 28. When the AC bias voltage is not applied and only the DC bias voltage is applied onto the photoreceptor drum, the photoreceptor drum 10 is not charged. When the AC bias voltage is applied, an oscillating electric field is formed, and uniform charging is obtained.

In the power supply 24 for bias voltage, the following operation is conducted: a constant voltage control is supplied to the DC component by a control suction which is not shown in the drawings; a constant current control is conducted on the AC component by the control section: and the DC component and the AC component can be independently turned ON, and OFF respectively. It is preferable that the forgoing ON and OFF operation changes the impressed voltage not instantaneously, but continuously. Specifically, it is preferable that the impressed voltage is changed over 1 to 500 msec, in order to prevent the magnet particles from depositing on the image forming body.

Numeral 25 is a casing to form a storing section of the magnetic particles, in which the cylinder 22 and the magnet 23 are disposed. A regulating plate 26 is provided at the exit of the casing 25, and regulates the layer thickness of the magnetic particles 21 which deposit on the cylinder 22 and are conveyed outside the casing 25. A gap between the regulating plate 26 and the cylinder 22 is adjusted so that the conveyed amount of the magnetic particles 21, that is, the amount of the magnetic particles deposited on the cylinder 22 is 10 to 200 mg/cm$^2$. This deposition amount is an average value in the contacting area of the magnetic brush. The gap between the photoreceptor drum 10 and the cylinder 22 is connected by the layer of the magnetic particles 21, the thickness of which is regulated. A stirring plate 27 is a rotating body having a plate member which corrects uneven distribution of the magnetic particles 21.

Figure 4:
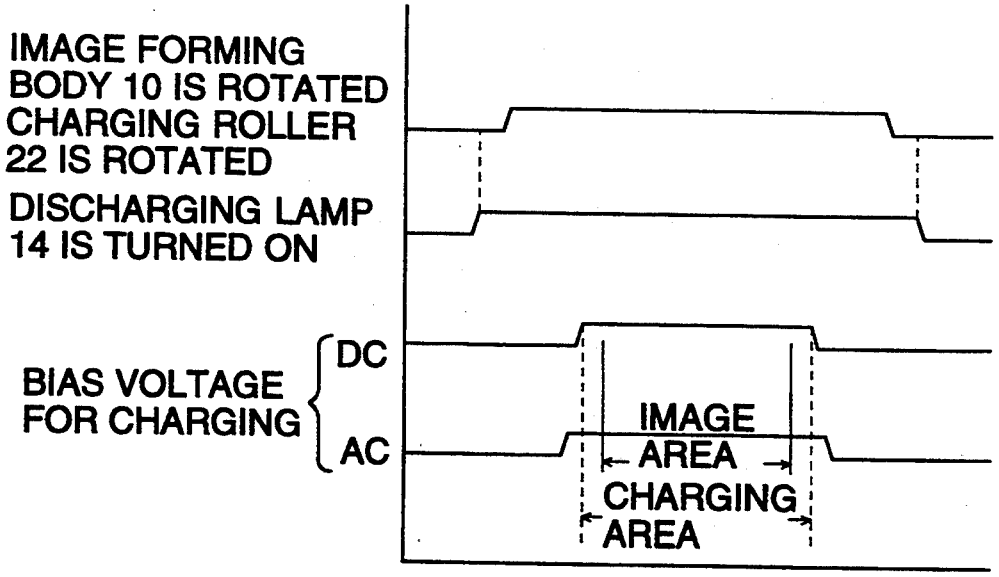
FIG. 4 is a time table of the first embodiment.

Next, operations of the first embodiment of the charging apparatus according to the present invention will be described below. FIG. 4 is a time table of the charging operation when one sheet is copied. When a copy stark command is sent from an operation section, not shown in the drawings, to a control section, not shown in the drawings, a discharge lamp 14, which is a discharge lamp, is turned on by the control section. The photoreceptor is irradiated with a beam of light, and next, the photoreceptor drum 10 is rotated in the arrowed direction in FIG. 2. The cylinder 22 of the charging apparatus 20 starts the rotation, being linked with the rotation of the photoreceptor drum 10. At this time, the bias voltage applied from the power supply for the bias voltage 24 is low, that is, the bias voltage is 0 V, or close to 0 V. Next, the AC bias voltage, on which the DC component is superimposed, is applied onto a predetermined area including the image area for charging. After the image has passed the image area, the photoreceptor is irradiated by the discharging lamp 14, and the bias voltage is changed to the low voltage of 0 V or close to 0 V. The image is written on the image area on the photoreceptor drum 10 by, for example, a laser beam L sent from an image writing unit, and an electrostatic latent image corresponding to the image is formed.

As shown in FIG. 1, a two-component developer is included in a developing unit 30, and stirred with stirring screws 33A and 33B. After that, the developer deposits to the outer periphery of a developing sleeve 31 rotating outside the magnet roller 32, and forms the magnetic brush with the developer. A predetermined bias voltage is applied onto the developing sleeve 31, and the reversal development is carried out in the developing area located opposite the photoreceptor drum 10. The developing area is located between the charging area and the image area.

The recording sheet P is fed from a sheet feed cassette 40 by a first sheet-feeding roller 41 one by one. The fed recording sheet P is sent to the photoreceptor drum 10 by a second sheet-feeding roller 42 which is rotated synchronously with the toner image on the photoreceptor drum 10. The toner image on the photoreceptor drum 10 is transferred onto the recording sheet P by a transfer roller 13, and the recording sheet P is then separated from the photoreceptor drum 10. The recording sheet P, onto which the toner image has been transferred, is sent to a fixing unit 81 through a conveyance means 80, and pinched between a thermal fixing roller and a pressing roller. After the recording sheet P has been fused and fixed, the recording sheet P is delivered outside the image forming apparatus. The surface of the photoreceptor drum 10, which is rotated with the toner remaining thereon which has not been transferred onto the recording sheet P, is cleaned when the toner is scraped off by a cleaning unit 50 with a blade 51. After the back end of the charging area has been discharged by a beam of light, the rotation of the photoreceptor drum 10 is stopped, then the discharging lamp 14 is turned off, and all is ready for the next copying cycle. In this connection, in the embodiment shown in FIG. 4, it is not necessary that the discharging lamp 14 is always turned on, but it may be turned off in the area onto which the AC component is applied from the power supply for the bias voltage 24. Further, it is preferable that the application of the AC component and DC component onto a predetermined area including the image area, from the mower supply for the bias voltage 24, is simultaneously conducted, or the AC component is applied for the longer time as shown in FIG. 4.

Figure 5:
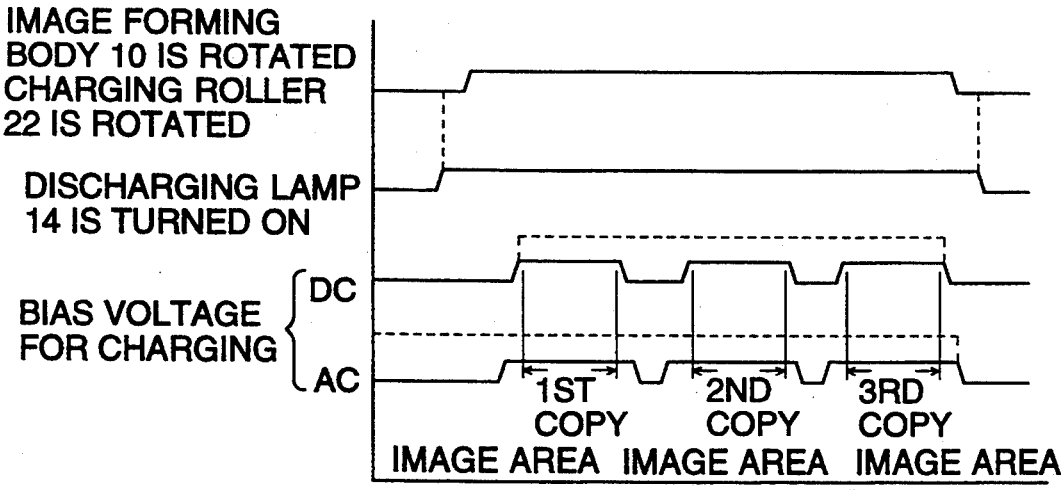
FIG. 5 is a time table when continuous copying is carried out in the first embodiment.

FIG. 5 is a time table of the charging operation when a continuous copying operation is carried out (3 continuous copying operations are shown in the drawing). As shown in the drawing, the discharging lamp 14 is turned on before the start of the photoreceptor drum 10 and turned off after the stop of the photoreceptor drum 10, in order to erase the previous optical information on the photoreceptor. Concerning the bias voltage for charging, the bias voltage of the AC component may also be applied through the continuous copying operation, as shown by a dotted line in the drawing. Further, the bias voltage of the DC component may also be applied for each copying operation or through the continuous copying operation, as shown by a dotted line in the drawing, under the condition that the AC component is applied.

Figure 6:
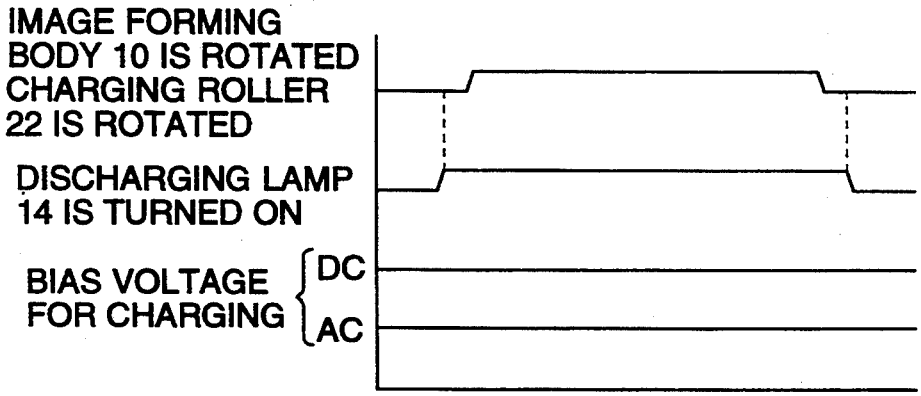
FIG. 6 is a time table when a copying operation recovers after a problem in the first embodiment.

FIG. 6 shows the operations of the copier when it has recovered from copying trouble such as paper jamming, or a power failure. The DC and AC components of the bias voltage for charging are set to be 0 V, and at least, the discharging lamp 14 is continuously turned on and irradiates the photoreceptor drum through one rotation of the photoreceptor drum 10 so that remaining charges on the photoreceptor are discharged, deposition of the magnetic particles to the photoreceptor is prevented for next charging, and the photoreceptor can be uniformly charged.

As described above, when the DC and AC bias voltage is applied between the cylinder 22 and the photoreceptor drum 10, electric charges are injected into the photoreceptor layer 10*a* through the conductive magnetic particles 21, and the charging operation is carried out. In this case, the bias voltage includes the DC component on which the AC component is superimposed. Accordingly, the movement of the electric charge and the injection of the electric charge from the magnetic brush, accompanied with discharging phenomena, can be carried out, and the efficiency thereof is increased, so that an extremely stable and uniform charging operation can be carried out at high speed.

Figure 11:
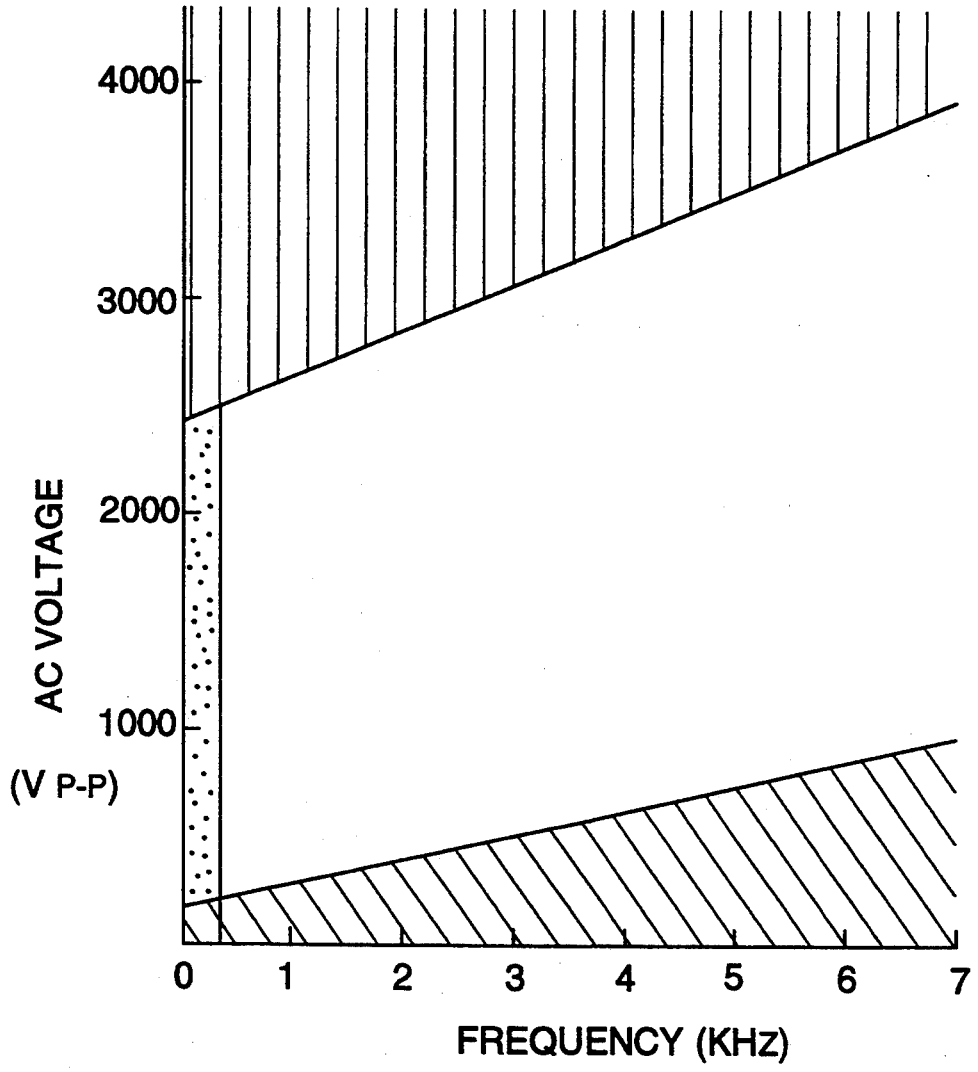
FIG. 11 is a charging characteristic diagram when the frequency and voltage of an AC voltage component are changed.

In the above embodiment, the result, in which the frequency and voltage of the AC voltage component to be applied onto the cylinder 22 are changed, is shown in FIG. 11.

In FIG. 11, hatched vertical lines indicate a range within which the dielectric breakdown easily occurs, and hatched inclined lines indicate a range within which uneven charging easily occurs. The non-hatched range indicates a preferable range within which stable charging can be carried out. As clearly seen from the drawing, the preferable range changes more or less due to the change of the AC voltage component. The wave shape of the AC voltage component is not limited to a sinusoidal wave, but may be a rectangular wave or a triangular wave. In FIG. 11, the dotted range, in which the frequency is lower than 300 Hz, indicates a range in which uneven charging occurs due to the low frequency.

Figure 7:
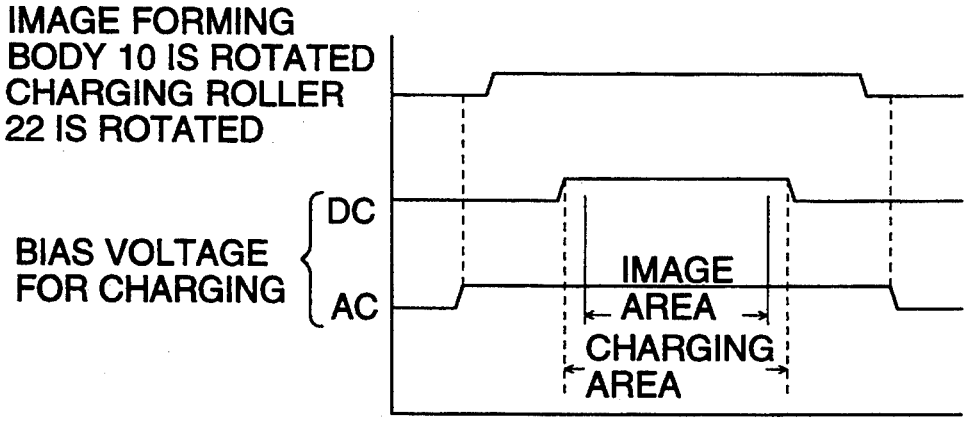
FIG. 7 is a time table of the second embodiment.

Next, operations of the second embodiment of the charging apparatus, according to the present invention, will be described. FIG. 7 is a time table of the charging operation when one sheet is copied. When a copy start command is sent from an operation section, not shown in the drawing, to a control section, not shown in the drawing, only a bias voltage of the AC component is applied from the power source for the bias voltage 24 provided in the charging apparatus 20 by a command of the control section. Next, the photoreceptor drum 10 is rotated in the arrowed direction. The cylinder 21 in the charging apparatus 20 is rotated being linked with the rotation of the photoreceptor drum 10, and the AC bias voltage is applied onto the photoreceptor. Due to this application, the voltage difference between the cylinder 21 and the photoreceptor 10 is decreased or eliminated, the deposition of magnetic particles onto the photoreceptor is prevented. Next, the AC bias voltage on which the DC component is superimposed is applied onto a predetermined area including the image area, and the charging operation is carried out. Only the AC bias voltage is applied onto the photoreceptor which has passed the image area, and the voltage difference between the cylinder 21 and the photoreceptor drum 10 is decreased or eliminated, so that the deposition of the magnetic particles to the photoreceptor is prevented. A latent image is formed in the image area on the photoreceptor drum 10 in the same way as the first embodiment, developed into a toner image, and transferred onto the recording sheet P. Remaining toner on the photoreceptor drum 10 is removed by a cleaning device 50, and then the photoreceptor drum 10 is stopped. Next, the bias voltage of the AC component is stopped, and the photoreceptor drum 10 stands by for the next copying operation.

Also in this embodiment, when the discharging lamp 14 is turned on and irradiates the photoreceptor drum, the voltage difference is decreased, so that the deposition of the magnetic particles onto the photoreceptor surface can be prevented.

Figure 8:
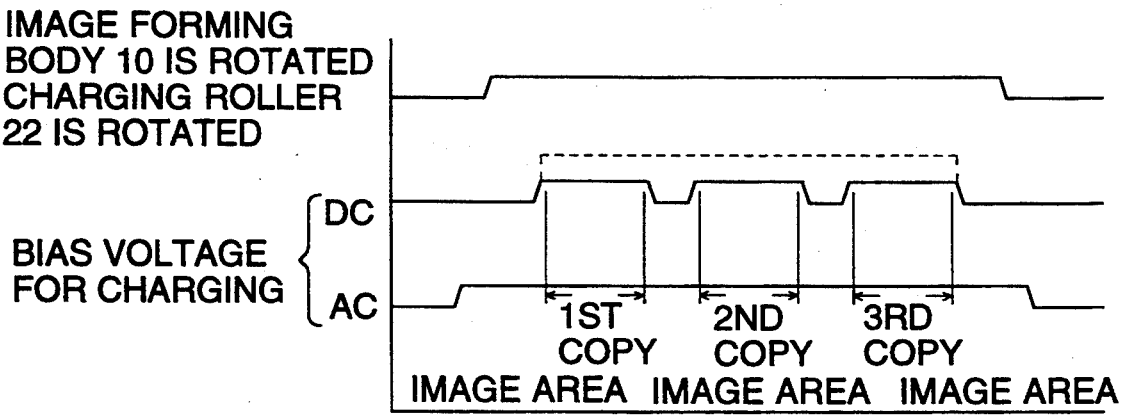
FIG. 8 is a time table when continuous copying is carried out in the second embodiment.

FIG. 8 is a time table of the charging operation when the continuous copying operations (3 continuous coping operations in the drawing) are carried out. As shown in the drawing, the AC bias voltage is applied before the start of the photoreceptor drum 10, and stopped after the photoreceptor drum 10 has been stopped. The DC bias voltage may be applied for each copying operation, or may be applied through the continuous copying operation, as shown by a dotted line in the drawing.

Figure 9:
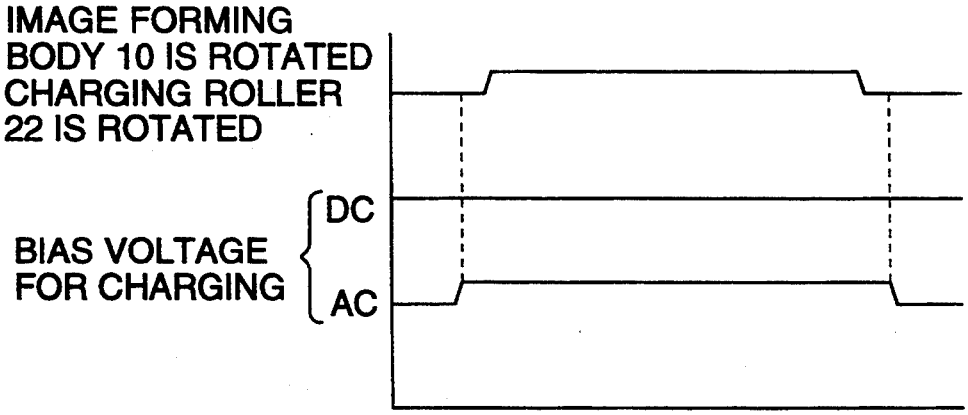
FIG. 9 is a time table when a copying operation recovers after a problem in the second embodiment.

FIG. 9 shows the operations of the copier when it has recovered from copying trouble such as paper jamming, or a power failure. When the trouble occurs, both the voltage potentials of the DC and AC components of the bias voltage for charging become a ground level. Then, at the time of recovery from the trouble, the AC component bias voltage is applied before the start of the rotation of the photoreceptor drum 10, and only the AC component bias voltage is continuously applied through at least one rotation. Due to this operation, residual charges on the photoreceptor are removed, and the deposition of the magnetic particles onto the photoreceptor at the next charging operation is prevented, so that uniform charging operations can be carried out.

Figure 10:
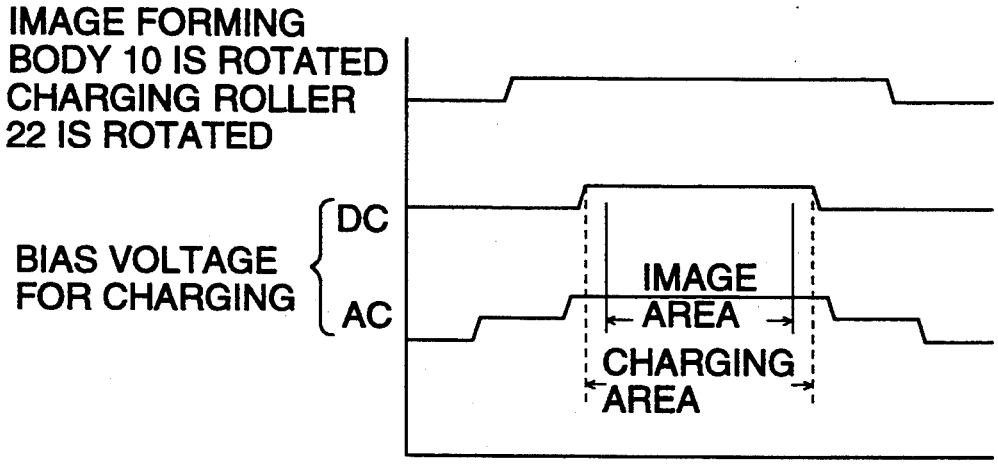
FIG. 10 is a time table in which the second embodiment is improved.

FIG. 10 is an improvement of the AC bias voltage application method of the embodiment shown in FIG. 7. In this improvement, the following control is carried out: the AC bias voltage having two values is applied; the AC bias voltage is reduced outside of the charging area, that is, before and after the charging area, the AC bias voltage is lower than that within the charging area so that no magnetic particle deposits onto the photoreceptor surface; the value of the lowered AC bias voltage is 0.3 to 0.8 times the peak-to-peak voltage $V_{p-p}$ of the high AC bias voltage at the time of charging; and the generation of ozone and the deterioration of the photoreceptor can be prevented.

Figure 12:
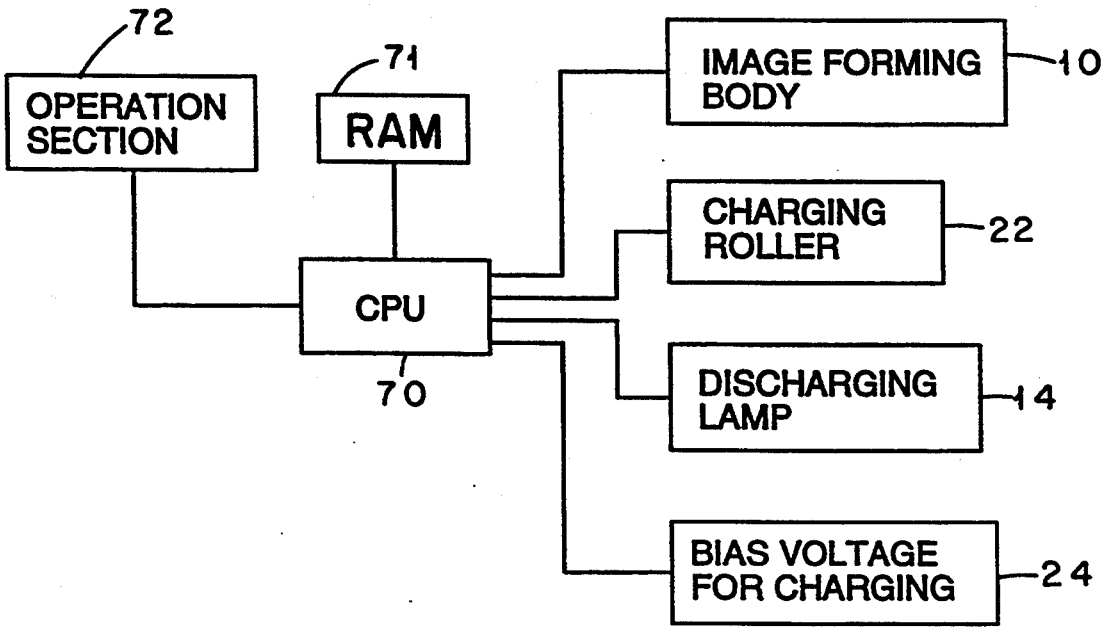
FIG. 12 is a view showing a composition of a control system of the present invention.

In the first and second embodiments, as shown in FIG. 12, the control section (CPU) 70 refers to data stored in a RAM 71 by the reception of signals sent from the operation section 72 and sensors, and the control section 70 controls the rotation of the image forming body, the rotation of the charging roller, turning on/off of the discharging lamp, and the bias voltage for charging.

Figure 13:
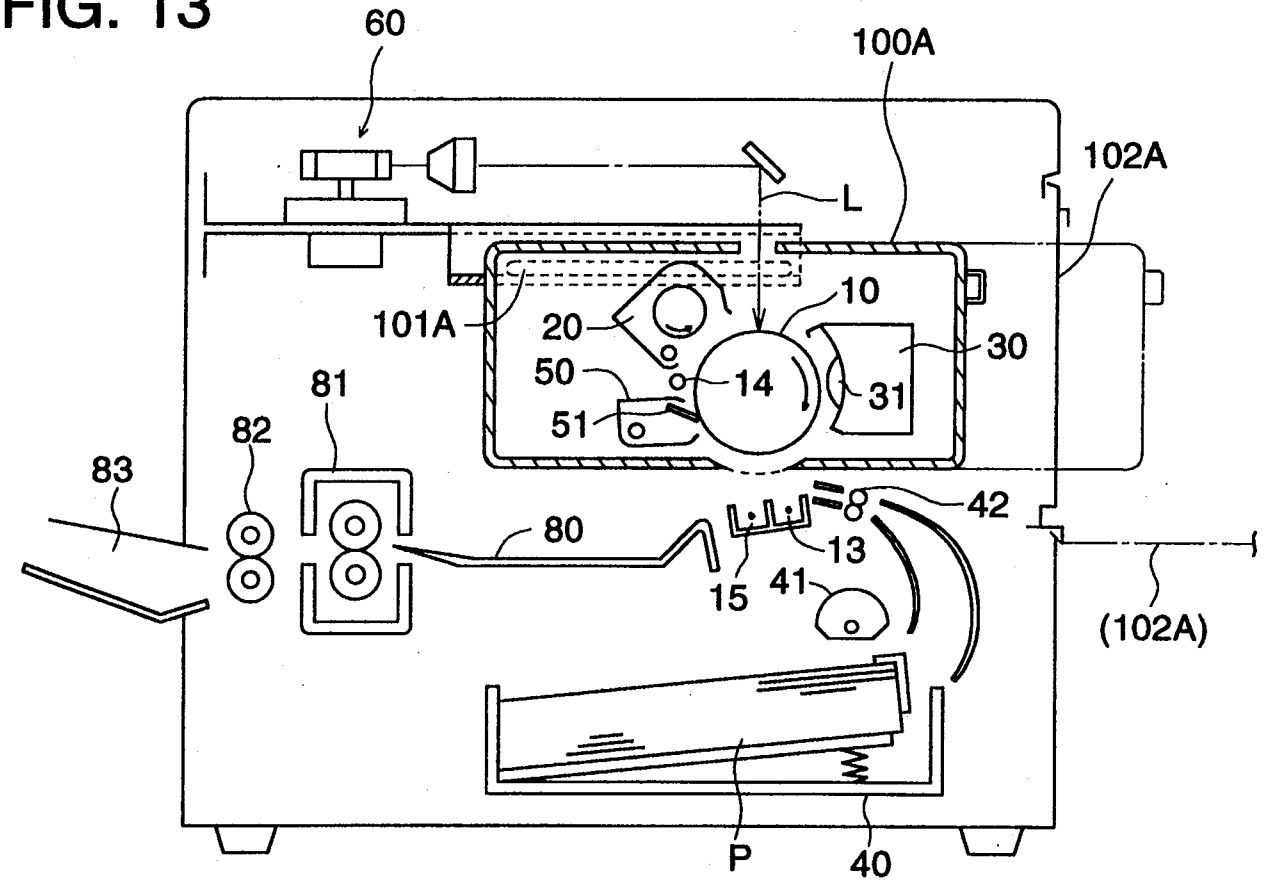
FIG. 13 is a sectional structural view of the image forming apparatus according to the present invention.

FIG. 13 is a sectional view showing the structure of the image forming apparatus with the charging apparatus, according to the present invention, more specifically than FIG. 1.

In the drawing, numeral 10 is a photoreceptor drum, formed of a negatively charged OPC, which is an image forming body rotated in the arrowed direction (clockwise). The discharging lamp 14, a charging apparatus 20, which will be described later, the developing device 30, and the cleaning device 50 are provided around the photoreceptor drum, and a beam of light of an image exposure L sent from the laser type exposure device 60 is directed onto the photoreceptor drum.

The photoreceptor drum 10, the charging apparatus 20, the developing device 30 and the cleaning device 50 are housed in a process cartridge 100A, and this cartridge is loaded in the apparatus main body. Under the condition that a side door 102A is opened, when the process cartridge 100A is pulled out in the right direction of the drawing, and slid on a pair of guide rails 101A, provided respectively on the front and rear surfaces of the cartridge, the process cartridge can be taken out as a unit from the apparatus main body.

A basic operation of the printing process of this apparatus is as follows. When a print-start command is sent from the operation section, not shown in the drawing, to the control section, not shown in the drawing, the photoreceptor drum 10 is rotated in the arrowed direction. Due to the rotation of the photoreceptor drum 10, the peripheral surface of the photoreceptor drum 10 is uniformly discharged by the discharging lamp 14, and after the discharged portion has passed the cleaning section, the photoreceptor drum is uniformly charged by the charging apparatus 20, which will be described later. The charging operation is carried out on only a predetermined area which includes the image area. An image is written on the photoreceptor drum 10 by the laser beam L sent from the laser exposure device 60, and the electrostatic latent image is formed corresponding to the image.

A two-component developer is loaded in the developing device 30, and stirred by the stirring screw. After that, the two component developer is deposited onto the outer periphery of a rotating developing sleeve 31 provided outside the magnet roller, and the magnetic brush is formed by the developer particles. A predetermined bias voltage is applied to the developing sleeve 31, and the reversal development is carried out in a developing area facing the photoreceptor drum 10.

The recording sheet P is fed from the sheet feed cassette 40 sheet by sheet by a first sheet-feeding roller 41. This recording sheet P is fed onto the photoreceptor drum 10 by a second sheet-feeding roller 42, which is synchronously operated with the toner image on the photoreceptor drum 10. Then, the toner image on the photoreceptor drum 10 is transferred onto the recording sheet P by the transfer device 13, and the recording sheet P is separated from the photoreceptor drum 10 by a separator 15. The recording sheet P, onto which the toner image is transferred, is conveyed to the fixing device 81 through the conveyance guide 80, and pinched by the thermal fixing roller and pressing roller. After the recording sheet P has been thermally fused, the recording sheet P is delivered onto a tray 83 through a delivery roller 82. The surface of the rotating photoreceptor drum 10, having thereon the toner, which remained without being transferred onto the recording sheet P, is cleaned by the cleaning device 50 having the blade 51. After the tail end of the charging area has been discharged by a discharging lamp 14, the photoreceptor drum 10 is stopped, and is ready for the next copying operation.

Figure 14:
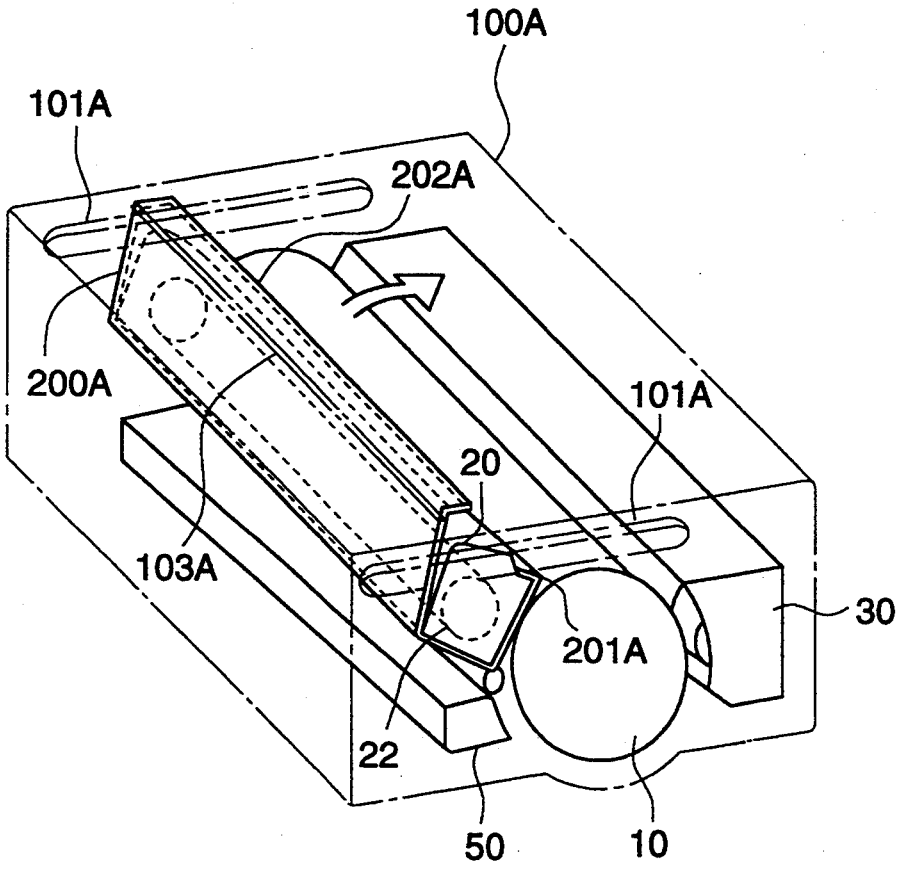
FIG. 14 is a perspective view of a process cartridge type (1) which is included in the image forming apparatus.
Figure 15:
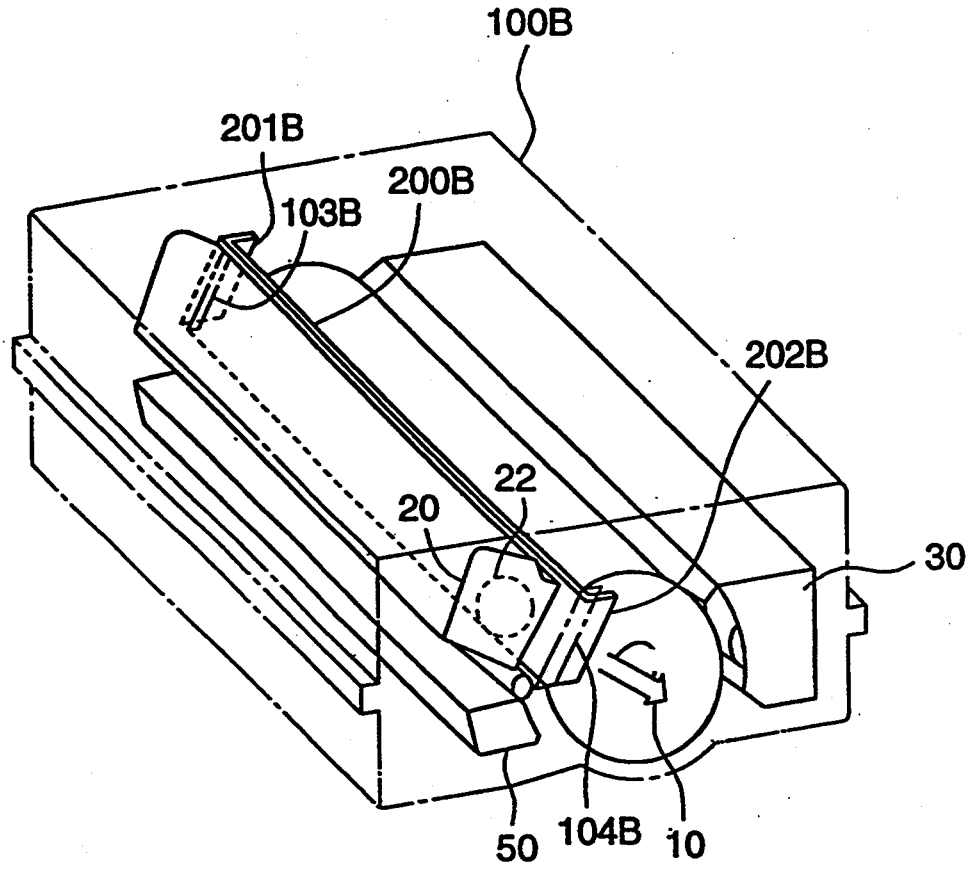
FIG. 15 is a perspective view of a process cartridge type (2) which is included in the image forming apparatus.

FIG. 14 and FIG. 15 show examples of the structure of the charging apparatus, according to the present invention, which is provided in the image forming apparatus shown in FIG. 13.

When the charging apparatus 20 is housed in the process cartridge, a seal member is interposed between the charging apparatus and the photoreceptor drum 10 so that the magnetic particles 21 and magnetic brush 21A are prevented from contacting the photoreceptor layer 10*a* of the photoreceptor drum 10.

The interposed seal member may be in contact with one or both of the charging roller of the charging apparatus or the charging roller to which the magnetic particles deposit, or photoreceptor.

For the above-mentioned seal member, material such as paper, or web is used, the surface hardness of which is low, which is highly flexible, and does not deteriorate physical characteristics of the photoreceptor layer 10*a* for a long period of time, and the seal member is kept under the interposed condition until the image forming apparatus has been shipped and starts its operation.

When the seal member is inserted into the process cartridge 100A, a seal member 200A having the shape shown in FIG. 14 is used. The seal member 200A is structured as follows: one side edge portion 201A of the seal member 200A is bent and fixed to a casing 25 of the charging apparatus 20; the casing 25 is covered by the seal member clockwise; and the other side edge portion 202A of the seal member is inserted into a slit 103A of the process cartridge 100A, bent, and fixed on the upper surface of the process cartridge 100A.

The above-mentioned side edge portions are respectively fixed with an adhesive seal, and accordingly, the adhesive seal can be easily peeled off. Accordingly, when the process cartridge 100A is pulled out to the position shown by a one-dotted chain line in FIG. 13, the seal member 200A can be taken out from the charging apparatus 20 in the arrowed direction shown in the drawing, and the charging apparatus 20 is ready for use.

As a result of the foregoing, a contacting portion of the seal member 200A with the photoreceptor drum 10 is moved in the upstream direction of the rotation of the photoreceptor drum 10, that is, to the cleaning device side. Therefore, in the case where the seal member 200A is taken out, even when the magnetic particles 21 fall from the charging apparatus, the magnetic particles 21 fall on the cleaning device 50 side, and do not interfere with the image formation. Further, since the magnetic particles, which have fallen on the photoreceptor drum 10, are collected again in the charging apparatus 20 by the rotation of the photoreceptor drum 10, the image formation is not hindered by the magnetic particles.

When the charging apparatus 20 is accommodated in the process cartridge 100B, a seal member 200B, the shape of which is shown in FIG. 15, is used. One side end portion 201B of the seal member 200B is inserted into a slit 103B provided in the rear surface of the process cartridge 100B and bent. After that, the side end portion 201B is fixed on the rear surface, and the seal member 200B partitions off the charging apparatus 20 and the photoreceptor drum 10. Further, the other side end portion 202B is inserted into a slit 104B provided in the front surface of the process cartridge 100B, bent, and fixed on the front surface of the process cartridge 100B.

Seal members 200A and 200B can also be structured in such a manner that they are automatically taken out with the pull out operation of the process cartridge. In this case, in order to easily remove the seal member, the charging apparatus 20 is preferably structured in such a manner that the charging apparatus 20 is slightly rotated in the direction opposite of the photoreceptor drum 10, and can temporarily be withdrawn from the photoreceptor drum 10.

Figure 16:
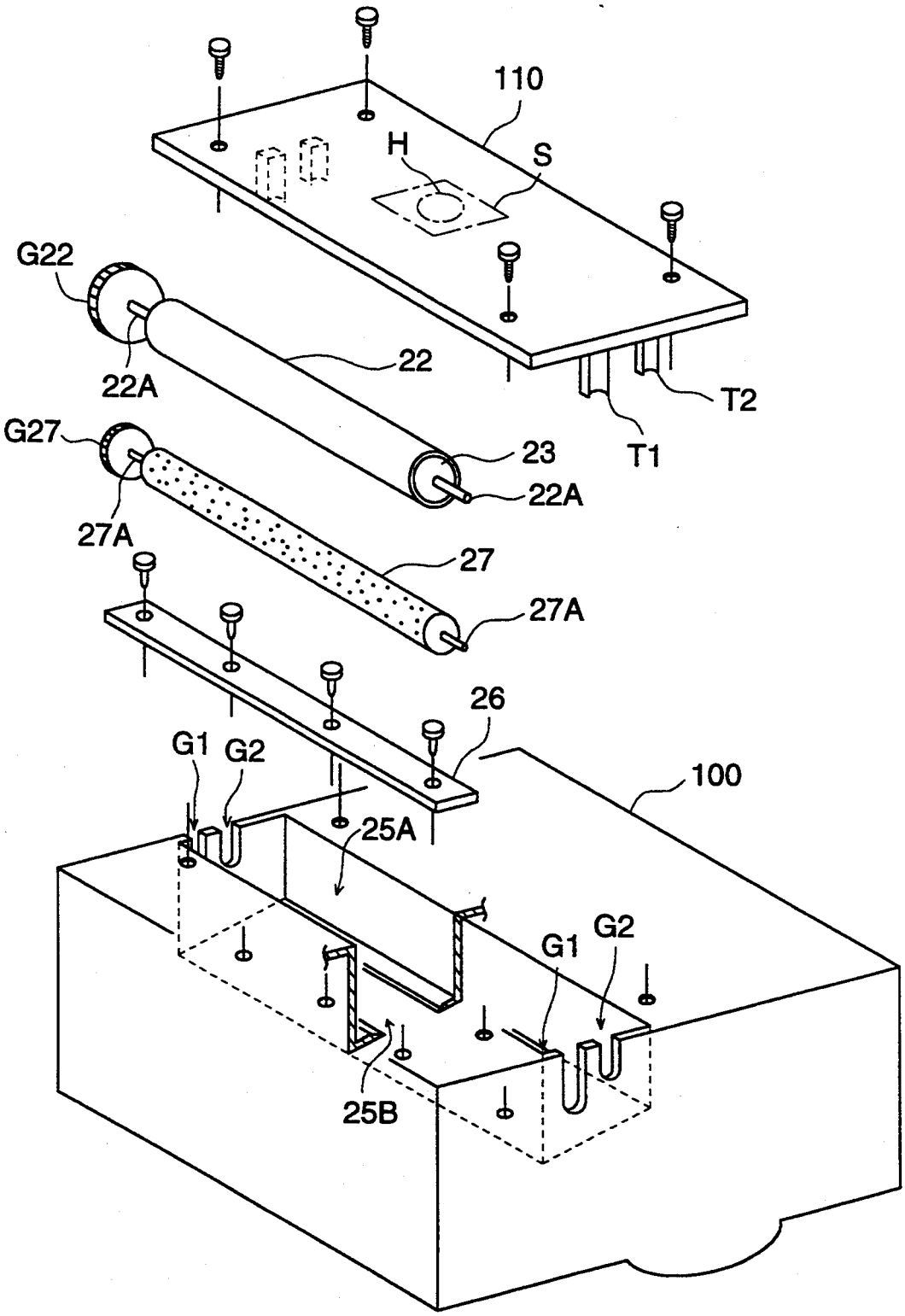
FIG. 16 is an exploded perspective view showing an example of the structure of the charging apparatus.

FIG. 16 shows an example of another structure of the charging apparatus of the image forming apparatus. A process cartridge 100 is integrally provided with a casing 25A, in which the charging apparatus 20 is housed, in the upper portion of the process cartridge 100.

The upper portion of the casing 25A is open wide, and an opening portion 25B, through which the cylinder 22 faces the photoreceptor drum 10, is provided in the lower portion of the casing 25A. A pair of slots G1 and G2 are respectively provided in the front and rear end walls.

When the charging apparatus 20 is assembled, at first, a regulation plate 26 is fixed by screws on the bottom surface of the casing 25A, and next, a sponge roller 27 and the cylinder 22, in which the magnet 23 is included, are assembled as a stirring member.

Neck portions 27A, 22A of the shafts of the sponge roller 27 and cylinder 22 are respectively engaged with the slots G1 and G2. The sponge roller 27 and the cylinder 22 are rotated by the driving power of the apparatus main body through gears G27 and G22 which are integrally provided with the sponge roller 27 and the cylinder 22 respectively. The magnet 23 is kept stationary by a fixed shaft (not shown in the drawing) which passes through the inner diameter portion of the cylinder 22.

After the charging apparatus 20 has been assembled, the casing 25A is hermetically closed when an upper plate 110 is screwed onto the upper portion. At the same time, bearing portions for the sponge roller 27 and the cylinder 22 are regulated by protrusions T1 and T2 provided on the lower surface of the upper plate 110.

Magnetic particles can be safely supplied to this structured charging apparatus 20 without being spilled when the upper plate 110 is removed from the charging apparatus 20.

Further, when a supply hole H is provided in a central portion of the upper plate 110 and covered by a seal S, the magnetic particles 21 can be supplied by only peeling off the seal S from the upper plate 110 without need of removing the plate from the casing.

Figure 17:
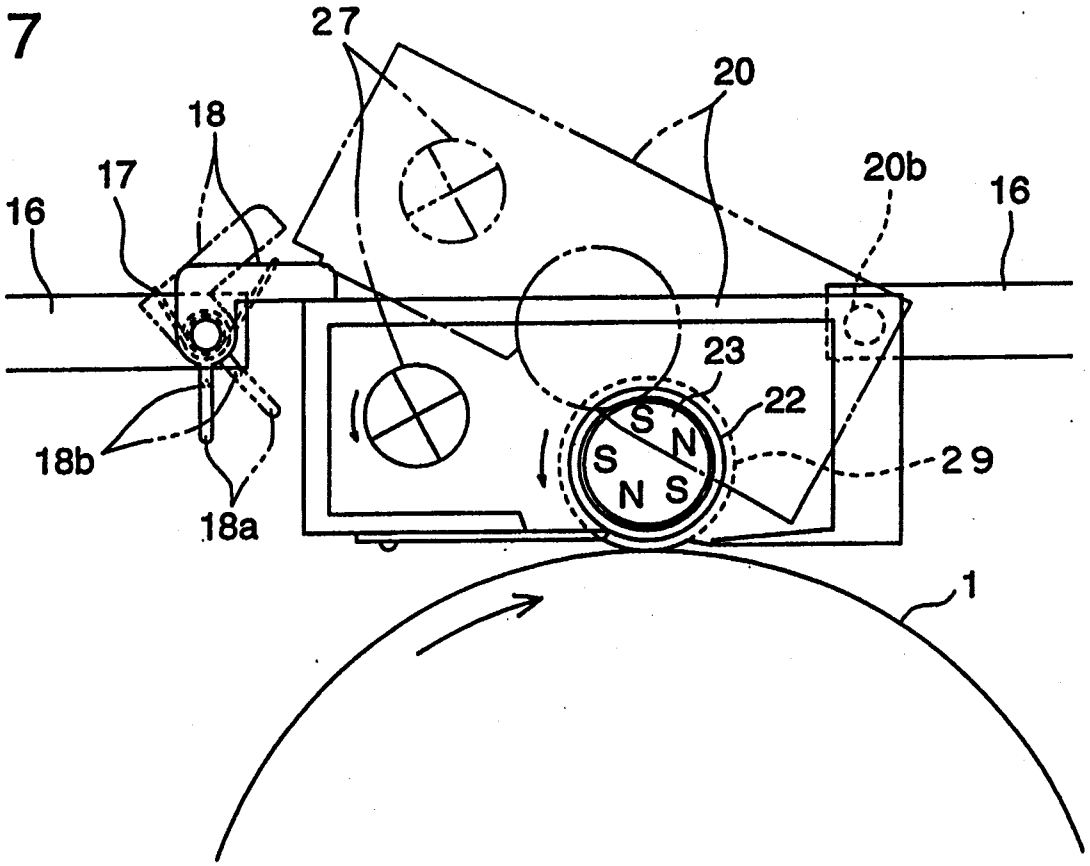
FIG. 17 is a partial side view showing an example of the structure of the magnetic brush type charging apparatus.

In an example of the structure shown in FIG. 17, a vessel or charging apparatus 20 is structured in such a manner that the upper surface of an opposite side of a shaft pin **20*b* provided in the vessel 20 is rotatable on the frame 16 by a shaft pin 20*b* so that the condition, in which the vessel 20 can be rotated to the position shown by the solid line in the drawing, can remain stable. The vessel 20 is counterclockwise rotatable while being pushed by a pressing member 18 which is clockwise rotatable by a coil spring 17 hooked between the frame 16 and the pressing member 18. The vessel 20 is rotated as shown by a two-dotted chain line in the drawing when the pressing member 18 is rotated counterclockwise by an operation lever 18*a*, integrally provided on the pressing member 18, until a stopper pin 18*b*, provided on the operation lever 18*a*, comes into contact with the frame 16, and the vessel 20** is rotated clockwise under those conditions.

Even when the above-mentioned pressing member 18 is not provided, the position of the shaft pin **20*b*, by which the vessel 20 is rotatably supported, is located on the downstream portion in which a gear 22*b* of the magnetic brush cylinder 22 is engaged with a gear integrally provided on the shaft of the image forming apparatus 1, and therefore, the force, which acts on the gear of the magnetic brush cylinder 22 and which is transmitted from the gear of the image forming body 1, produces a counterclockwise torque, by which a spacer roller 29 contacts with the outer periphery of the image forming body 1, in the vessel 20. Thereby, the condition, in which the vessel 20 is rotated to the position shown by the solid line, can be kept stable. Accordingly, the transmission of the rotation from the image forming body 1 to the magnetic brush cylinder 22 and the stirring member 27** is smoothly carried out.

A gear ratio of the gear of the image forming body 1 and the gear of the magnetic brush cylinder 22, which are engaged with each other, is an integer. Because a phase of the rotation of the magnetic brush cylinder 22 for each rotation of the image forming body 1 is the same as that of the image forming body 1, even when periodical non-uniform charging of the image forming body 1 occurs accompanied with the rotation of the magnetic brush cylinder 22, the phase of the non-uniformity coincides with the phase of electrostatic images which are developed with toners of Y, M, C and B. Therefore, when a color image is formed, the influence of the above-mentioned non-uniformity can be greatly reduced.

What is claimed is:

1. An image forming apparatus, comprising:

image forming body means for forming a toner image on a surface thereof;

charging means for charging said surface with a bias voltage, including a DC component and a AC component, through a magnetic brush member which is in contact with said surface;

driving means for moving said surface of said image forming body means and said magnetic brush member in synchronism;

image exposing means for imagewisely exposing a predetermined image area of said surface, which is charged by said charging means, so that a latent image is formed on said surface; and discharge lamp means for exposing said surface with light so that said surface is discharged;

wherein before said driving means starts moving said surface and said magnetic brush member, said discharge lamp means exposes said surface with said light, and said bias voltage, with which said surface is charged, is substantially zero; and after said driving means starts moving said surface and said magnetic brush member, said predetermined image area of said surface is charged with said bias voltage including said DC component and said AC component.

2. The image forming apparatus of claim 1, wherein while said driving means moves said surface and said magnetic brush member, said discharge lamp means continues to expose said surface with said light, and said bias voltage, with which an area of said surface other than said predetermined image area is charged, is substantially zero; and after said driving means stops moving said surface and said magnetic brush member, said discharge lamp means stops exposing said surface.

3. An image forming apparatus, comprising:

image forming body means for forming a toner image on a surface thereof;

charging means for charging said surface with a bias voltage, including a DC component and a AC component, through a magnetic brush member which is in contact with said surface;

driving means for moving said surface of said image forming body means and said magnetic brush member in synchronism;

image exposing means for imagewisely exposing a predetermined image area of said surface which is charged by said charging means so that a latent image is formed on said surface; and discharge lamp means for exposing said surface with light so that said surface is discharged;

wherein said bias voltage, with which said surface is charged, consists only of said AC component before said driving means starts moving said surface and said magnetic brush member; and said predetermined image area of said surface is charged with said bias voltage including said DC component and said AC component, after said driving means starts moving said surface and said magnetic brush member.

4. The image forming apparatus of claim 3, wherein while said driving means moves said surface and said magnetic brush member, said discharge lamp means continues to expose said surface with said light, and said bias voltage, with which an area of said surface other than said predetermined image area is charged, consists only of said AC component; and after said driving means stops moving said surface and said magnetic brush member, said charging means stops charging said surface with said AC component of said bias voltage.

* * * * *

UNITED STATES PATENT AND TRADEMARK OFFICE

CERTIFICATE OF CORRECTION

PATENT NO. : 5,426,489

DATED : June 20, 1995

INVENTOR(S) : Satoshi Haneda et al.

It is certified that error appears in the above-indentified patent and that said Letters Patent is hereby corrected as shown below:

Claim 1, column 16, line 30 and claim 3, column 16, line 66, "a" (second occurrence) should read --an--.

In the abstract, line 6, "a" (first occurrence) should read --an--;

line 14, "the" (second occurrence) should read --an--.

Signed and Sealed this

Fourth Day of June, 1996

Bruce Lehman

*Attest:*

BRUCE LEHMAN

*Attesting Officer*

*Commissioner of Patents and Trademarks*